US008979592B2

(12) United States Patent
Dang

(10) Patent No.: US 8,979,592 B2
(45) Date of Patent: Mar. 17, 2015

(54) ELECTRICAL CONNECTOR FOR HIGH-SPEED DATA TRANSMISSION

(71) Applicant: Carlisle Interconnect Technologies, Inc., Kent, WA (US)

(72) Inventor: Phong Dang, Auburn, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 9 days.

(21) Appl. No.: 13/841,092

(22) Filed: Mar. 15, 2013

(65) Prior Publication Data

US 2014/0273591 A1 Sep. 18, 2014

(51) Int. Cl.

| | |
|---|---|
| ***H01R 13/648*** | (2006.01) |
| ***H01R 13/627*** | (2006.01) |
| ***H01R 13/6582*** | (2011.01) |
| ***H01R 13/6593*** | (2011.01) |

(52) U.S. Cl.
CPC ..... *H01R 13/6271* (2013.01); *H01R 13/6582* (2013.01); *H01R 13/6593* (2013.01)
USPC ..... 439/607.55; 439/607.41

(58) Field of Classification Search
CPC . H01R 24/64; H01R 13/6463; H01R 13/6658
USPC ..... 439/607.41–607.52, 607.55–607.57
See application file for complete search history.

(56) References Cited

U.S. PATENT DOCUMENTS

| | | | | |
|---|---|---|---|---|
| 4,191,443 | A | 3/1980 | Doyle | |
| 4,261,633 | A | 4/1981 | Abernethy | |
| 5,797,770 | A | 8/1998 | Davis et al. | |
| 6,077,122 | A | 6/2000 | Elkhatib et al. | |
| 6,190,202 | B1 | 2/2001 | Lai | |
| 6,227,910 | B1 * | 5/2001 | Huang | 439/607.41 |
| 6,244,892 | B1 | 6/2001 | McCarthy | |
| 6,328,601 | B1 | 12/2001 | Yip et al. | |
| 6,503,102 | B1 * | 1/2003 | Zhang et al. | 439/607.55 |
| 6,544,067 | B2 | 4/2003 | Hagmann | |
| 6,554,648 | B2 * | 4/2003 | Shi et al. | 439/607.55 |

(Continued)

FOREIGN PATENT DOCUMENTS

| | | | |
|---|---|---|---|
| EP | 2 355 258 | A1 | 2/2011 |
| FR | 2 805 932 | A1 | 3/2000 |
| WO | WO 2010/115514 | A2 | 10/2010 |

OTHER PUBLICATIONS

International Electrotechnical Commission, Publicly Available Specification IEC/PAS 61076-2-109 (Pre-Standard), Edition 1.0, dated Mar. 2010, 8 pages.

(Continued)

*Primary Examiner* — Ross Gushi
(74) *Attorney, Agent, or Firm* — Stoel Rives LLP

(57) ABSTRACT

An electrical connector includes an electrically conductive front and rear shell. The front shell includes a cantilever structure extending from a rear face in an axial direction, the cantilever structure having a catch on a free end thereof. The catch mates with a retention slot located on the rear shell to latch together the front and rear shells of the electrical connector. A contact-receiving cavity formed within the front and rear shells houses an insulating sheath carrying electrical contacts. The electrical connector may further include tangs formed as an integral part of the front shell for bearing against a mating end of a mating connector. The electrical connector may include a retention latch for seating the electrical connector within a separate connector housing.

27 Claims, 5 Drawing Sheets

(56) References Cited

U.S. PATENT DOCUMENTS

| | | | | |
|---|---|---|---|---|
| 6,659,801 | B2 * | 12/2003 | Nishio et al. | 439/607.48 |
| 6,659,804 | B2 * | 12/2003 | Nishio et al. | 439/660 |
| 6,749,464 | B2 * | 6/2004 | Obata | 439/607.41 |
| 6,783,397 | B2 * | 8/2004 | Yang Lee | 439/607.45 |
| 6,857,904 | B2 * | 2/2005 | Lai | 439/607.43 |
| 6,893,296 | B2 | 5/2005 | Aekins et al. | |
| 7,018,237 | B2 * | 3/2006 | Zhan et al. | 439/607.55 |
| 7,094,103 | B2 * | 8/2006 | Lai | 439/607.45 |
| 7,153,168 | B2 | 12/2006 | Caveney et al. | |
| 7,172,466 | B2 | 2/2007 | Aekins et al. | |
| 7,195,518 | B2 | 3/2007 | Bert et al. | |
| 7,255,613 | B2 | 8/2007 | Mackey et al. | |
| 7,316,584 | B2 | 1/2008 | Mackillop et al. | |
| 7,690,948 | B2 * | 4/2010 | Lung | 439/607.27 |
| 7,727,020 | B2 * | 6/2010 | Gladd et al. | 439/607.41 |
| 7,736,159 | B1 | 6/2010 | Effinger, III et al. | |
| 7,736,190 | B2 * | 6/2010 | Yuan et al. | 439/660 |
| 7,794,279 | B1 * | 9/2010 | Ye et al. | 439/607.54 |
| 7,883,372 | B1 * | 2/2011 | Sun et al. | 439/607.55 |
| 8,002,582 | B2 * | 8/2011 | Fakhri et al. | 439/607.44 |
| 8,007,319 | B2 * | 8/2011 | Dang | 439/607.56 |
| 8,568,173 | B2 * | 10/2013 | Wu | 439/607.56 |
| 8,591,259 | B2 * | 11/2013 | Wu | 439/607.27 |
| 8,602,822 | B2 * | 12/2013 | Siahaan et al. | 439/607.41 |
| 8,696,385 | B2 * | 4/2014 | Wu | 439/607.56 |
| 2001/0053630 | A1 * | 12/2001 | Shi et al. | 439/607 |
| 2002/0045385 | A1 * | 4/2002 | Wang | 439/610 |
| 2002/0142659 | A1 * | 10/2002 | Nishio et al. | 439/610 |
| 2003/0096529 | A1 | 5/2003 | Brennan et al. | |
| 2004/0147166 | A1 * | 7/2004 | Lai | 439/610 |
| 2004/0147167 | A1 * | 7/2004 | Lai | 439/610 |
| 2004/0157493 | A1 | 8/2004 | Bergner et al. | |
| 2004/0259421 | A1 * | 12/2004 | Lai | 439/610 |
| 2005/0026501 | A1 * | 2/2005 | Zhan et al. | 439/607 |
| 2008/0020644 | A1 * | 1/2008 | Haas | 439/610 |
| 2008/0096433 | A1 | 4/2008 | Bixler et al. | |
| 2008/0207057 | A1 * | 8/2008 | Akino | 439/610 |
| 2009/0017684 | A1 * | 1/2009 | Lin | 439/610 |
| 2009/0104819 | A1 | 4/2009 | Hermant et al. | |
| 2009/0280687 | A1 * | 11/2009 | Liu et al. | 439/607.55 |
| 2010/0048061 | A1 | 2/2010 | Helmig et al. | |
| 2011/0086547 | A1 * | 4/2011 | Akino | 439/607.41 |
| 2011/0136369 | A1 * | 6/2011 | Dang | 439/352 |
| 2011/0281465 | A1 * | 11/2011 | Hou | 439/607.55 |
| 2012/0171884 | A1 * | 7/2012 | Dang | 439/310 |
| 2013/0023154 | A1 * | 1/2013 | Ii | 439/607.5 |
| 2013/0052866 | A1 * | 2/2013 | Ii | 439/607.41 |
| 2013/0084747 | A1 * | 4/2013 | Dendas et al. | 439/607.41 |
| 2014/0038459 | A1 * | 2/2014 | Kobayashi | 439/607.41 |
| 2014/0120769 | A1 * | 5/2014 | Dang | 439/607.05 |

OTHER PUBLICATIONS

Siemon, Network Cabling Solutions, Siemon Z-MAX Category 6A Structured Cabling System, http://www.siemon.com/us/zMAX, visited Dec. 5, 2011, 8 pages.

Siemon, Network Cabling Solutions, Siemon's Z-MAX Structured Cabling Solution: Reinventing the RJ-45 for Tomorrow's Network, Feb. 2009, 12 pages.

Yoshitake, James, Interconnect Solutions for Aircraft Ethernet Data Networks, Defense Electronics Magazine, Oct. 2007, pp. 14-17, Penton Media, Inc.

Phoenix Contact, Assembly Instructions, VS-08-M12MS-10G-P SCO and VS-08-M12MR-10G-P SCO, dated Mar. 2010, 1 page.

Amphenol Aerospace, OCS (Oval Contact System) Connectors, dated Jan. 2013, 7 pages.

* cited by examiner

ELECTRICAL CONNECTOR FOR HIGH-SPEED DATA TRANSMISSION

TECHNICAL FIELD

The field of this disclosure relates to electrical connectors and, in particular, to a cable-terminating electrical connector system having enhanced shielding to reduce interference and crosstalk amongst different wires of the cable and different conductors of the connector system.

BACKGROUND

Increasingly, electronic devices transmit and receive high-frequency electrical signals representing digital data. High-speed data transmission, such as so-called Ultra High-Speed (UHS) data transmission involves the transmission of data between electronic devices at rates of 1 to 10 gigabits per second using signal frequencies of 100 MHz to 500 MHz. There is a desire for future high-speed data transmission at even faster rates and at even higher frequencies. For example, UHS data transmission may be achieved over 1000BASE-T Ethernet networks using category 5, 5E, 6 or 6A cables. Such high-speed digital data networks are not confined to terrestrial applications, especially as high-speed electronics are developed for aerospace and other suitable applications.

High-speed digital data transmission is facilitated by a data transmission system with a relatively high signal to noise ratio. For example, one system includes a 1000BASE-T Ethernet network that includes category 5, 5E, 6 or 6A cables. Cables in such a system are designed to propagate data signals without generating or introducing appreciable noise, and are terminated by electrical connectors at either end to either connect cables together, or to connect cables to electronic devices. Electrical connectors commonly used for terrestrial applications, such as the RJ-45 style connector, have proved to be less than suitable for aerospace and other applications. In aerospace and other applications, electrical connectors are subjected to a variety of harsh environmental conditions, such as the presence of moisture, vibrations and mechanical shock, relatively high amounts of external electrical and magnetic interference, and pressure changes, all of which can detrimentally affect an electrical connector's performance, that is, its ability to transmit data signals while maintaining a relatively high signal to noise ratio. Common electrical connectors for aerospace and other suitable applications, such as the Quadrax-style connector, may work for data transfer rates less than 1 gigabit per second, but tend to exhibit, induce, generate or introduce excessive noise during high-speed data transmission at rates faster than 1 gigabit per second.

Because degraded performance of an electrical connector adversely affects the ability of a system to transfer data at high rates, the present inventor has recognized a need for a robust electrical connector capable of facilitating high-speed data transfer in aerospace and other suitable applications, for example, in aircraft electronic systems having performance criteria meeting gigabit data transfer standards such as 1000BASE-T. In addition, the present inventor has recognized a need for an improved connector with a streamlined design and is easily assembled without sacrificing performance. Additional aspects and advantages will be apparent from the following detailed description of preferred embodiments, which proceeds with reference to the accompanying drawings.

DETAILED DESCRIPTION OF PREFERRED EMBODIMENTS

Figure 1:
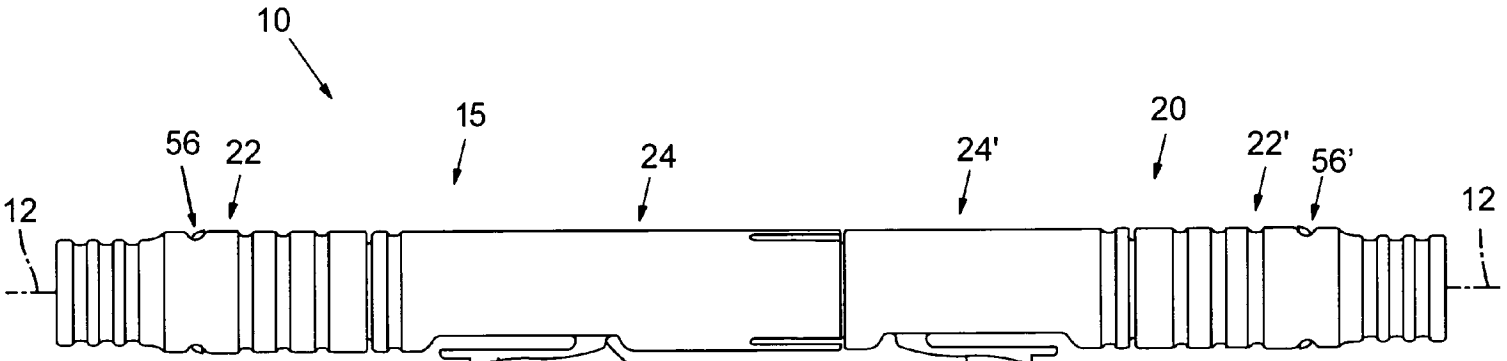
FIG. 1 is a side view of an electrical connector assembly including mating socket and plug connectors.
Figure 2:
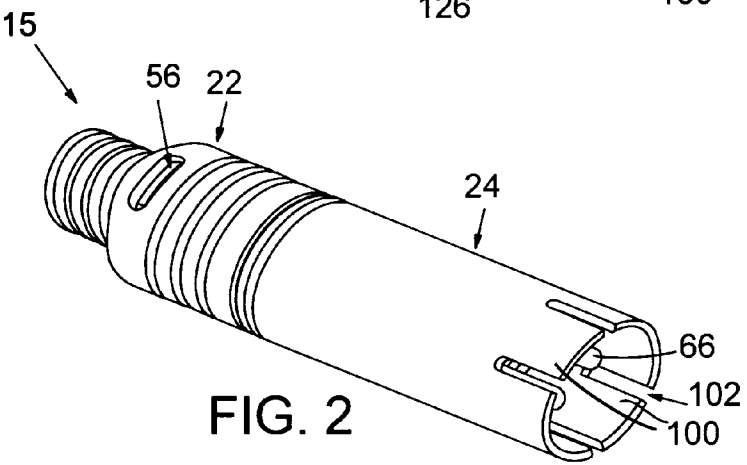
FIGS. 2 and 3 are perspective views of the plug connector of FIG. 1.

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

An embodiment of an electrical connector system 10 is described with reference to FIGS. 1-11. The following briefly describes an example arrangement of the components of electrical connector system 10, which includes a plug connector 15 and a socket connector 20. Electrical connector system 10 may be used to connect two cable segments together for high-speed data transfer, for example, data transferred at rates of 1 gigabit per second and faster by signals generated at frequencies ranging from approximately 100 MHz to approximately 600 MHz and faster.

Figure 4:
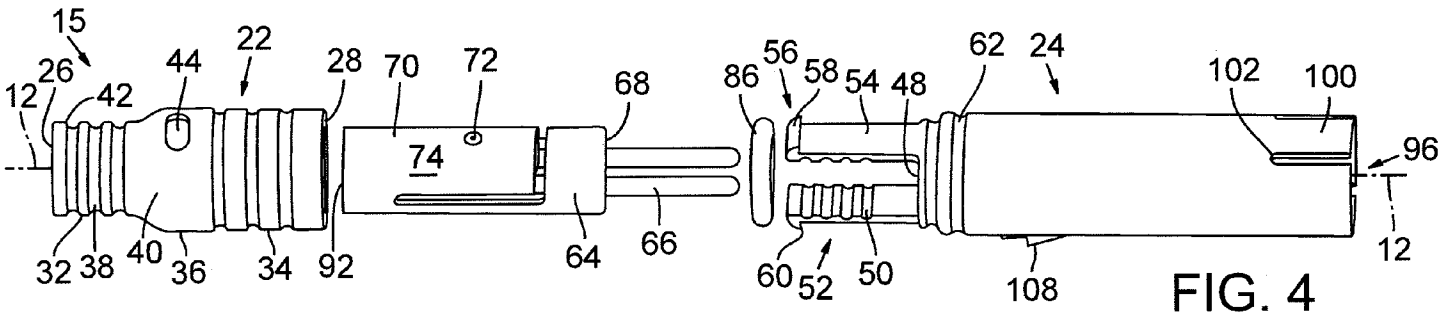
FIG. 4 is an exploded view of the plug connector of FIG. 2.
Figure 5:
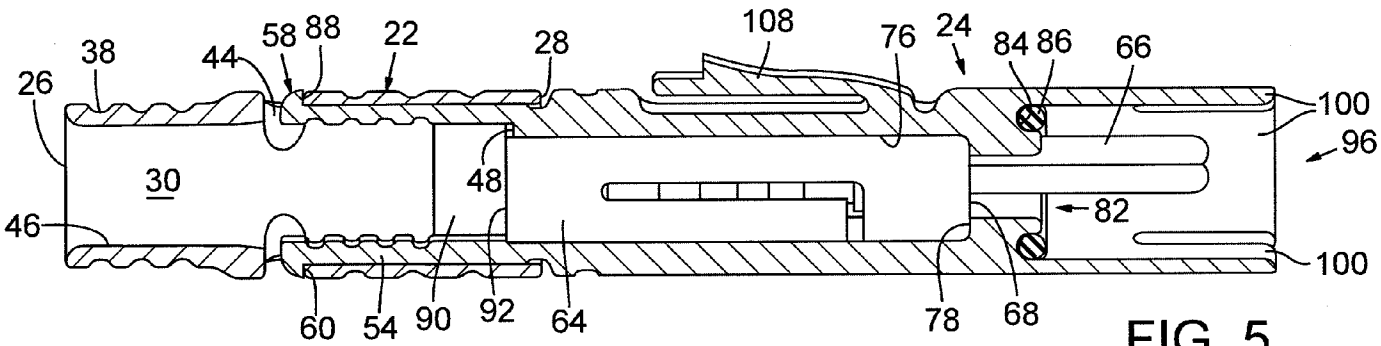
FIG. 5 is a cross-section view of the plug connector of FIG. 2

With reference to FIG. 1, an electrical connector system 10 includes a plug connector 15 that mates and interfaces with a socket connector 20 to create an electrical connection between two cables or other wiring (omitted from the figures for clarity). With particular reference to FIGS. 4 and 5, plug connector 15 includes a rear shell 22 and a front shell 24. Rear and front shells 22, 24 house an electrically insulating sheath 64 (or another non-conductive enclosure) having multiple pin contacts 66. Front shell 24 includes a cantilever structure 52 extending forwardly in an axial direction 12 (e.g., parallel to axis 12) from a rear face 48. The free end of cantilever structure 52 includes a catch 56 that mates with a pair of retention slots 44 on rear shell 22 to latch together and retain rear and front shells 22, 24.

Socket connector 20 includes many similar components that may be arranged in a similar fashion as described with respect to plug connector 15. For instance, with reference to FIGS. 8 and 9, socket connector 20 includes rear and front shells 22', 24' and an insulating sheath 64' housing multiple socket contacts 94. Socket connector 20 further includes a cantilevered structure 52' that mates with retention slots 44' to latch together rear and front shells 22', 24'.

Figure 6:
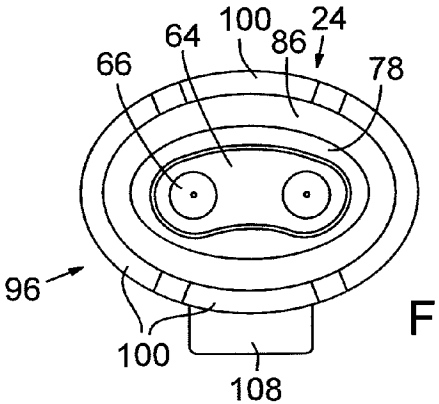
FIG. 6 is a front view of a mating end of the plug connector of FIG. 2.
Figure 9:
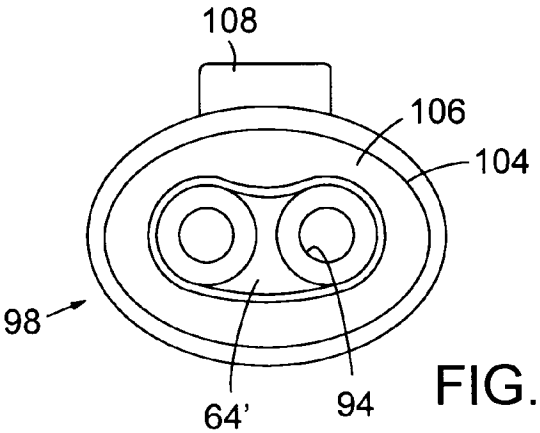
FIG. 9 is a front view of a mating end of the socket connector of FIG. 7.

One difference between plug and socket connectors 15, 20 is the configuration of their respective mating ends 96, 98 (FIGS. 6 and 9). In one embodiment, front shell 24 of plug connector 15 includes a pair of tangs 100 on mating end 96, while front shell 24' of socket connector 20 includes a tongue 104 shaped to mate with mating end 96 of plug connector 15. In some embodiments, tongue 104 has a smaller circumference in relation to front shell 24, and in particular, to mating end 96 of front shell 24, and is dimensioned to provide an interference fit with mating end 96.

In one example assembly process of electrical connector system 10, mating end 98 of socket connector 20 may be moved along axial direction 12 to connect into mating end 96 of plug connector 15. As plug connector 15 and socket connector 20 are slidably moved together and mated, pin contacts 66 are inserted into and received by socket contacts 94. As described above, the interference fit between tongue 104 and tangs 100 provide a mechanical engagement where tangs 100 surround and bear against tongue 104 of socket connector 20. Tangs 100 help retain the connectors 15, in a mated configuration even when subjected to mechanical vibrations and stresses, such as mechanical and thermal stresses.

The following describes further detailed aspects of this and other embodiments of the electrical connector system 10. It should be understood that certain embodiments may be illustrated or described herein in the context of particular electrical connectors, such as socket and plug connector assemblies, or other similar connectors. However, as will become apparent from the following disclosure, the embodiments described herein may be implemented with different kinds of connectors and coupling devices.

As briefly mentioned above, plug connector 15 and socket connector 20 may include a number of identical or substantially similar components. Accordingly, the following description may group and describe like components or may refer to like components with prime numbers to avoid repetition. In addition, to provide an easy frame of reference, certain complementary components are illustrated and described as being carried by one of the electrical connectors 15, 20. It should be understood that although components may be illustrated and described with respect to one connector and not the other, the location of such components may be interchangeable between the electrical connectors 15, 20 without departing from the principles of the disclosed subject matter.

FIG. 1 illustrates an electrical connector system 10 according to one embodiment. Electrical connector system 10 includes a plug connector 15 that mates and interfaces with a socket connector 20 to create an electrical connection between cables or other wiring (not illustrated for clarity). With reference to FIGS. 2-6, plug connector 15 includes a rear shell 22 and a front shell 24. Each of rear and front shells 22, 24 are preferably made from an electrically conductive material that provides EMI shielding (i.e., to inhibit electromagnetic interference). For instance, rear and front shells 22, 24 may be made from aluminum alloys, steel, copper or other suitable electrically conductive material. In other embodiments, rear and front shells 22, 24 may be made from an insulating material, such as polyetherimide or other suitable plastic, and coated or plated with an electrically conductive material, such as silver, gold, or nickel.

With particular reference to FIGS. 4 and 5, rear shell 22 includes a rear face 26, an opposite front face 28, and a cavity 30 extending between rear and front faces 26, 28. To establish a frame of reference, rear shell 22 may be divided into three roughly equal regions, including a leading portion 32 (adjacent rear face 26), a trailing portion 34 (adjacent front face 28), and a central portion 36 spanning between leading and trailing portions 32, 34. In one embodiment, leading portion 32 may have a smaller circumference than both trailing portion 34 and central portion 36. In such a configuration, rear shell 22 may taper smoothly from leading portion 32 to central portion 36. In other embodiments, rear shell 22 may have a uniform circumference throughout.

One or both of leading and trailing portions 32, 34 may include one or more grooves 38 formed on an exterior surface 40 of rear shell 22. If desired, central portion 36 may also include grooves 38, but in some embodiments, central portion 36 is free of grooves 38. Grooves 38 are preferably circumferential, that is, each groove 38 defines a continuous loop around exterior surface 40 at leading and trailing portions 32, 34. Grooves 38 provide a suitable surface for receiving and securing a heat-shrink tubing or other sealing material to form a moisture ingress resistant seal after rear and front shells 22, 24 have been mated (as further described below). In an example assembly process, grooves 38 may be filled with epoxy or other adhesive substance and a heat-shrink tube placed thereon. When heat is applied, the heat-shrink tube softens and flows into grooves 38. After the assembly cools, the tube has a solid mechanical grip with the front shell 24. In some embodiments, each groove 38 may include a rounded edge 42 instead of sharp corners that could damage or rupture the heat-shrink tubing and thereby degrade the moisture seal.

Rear shell 22 further includes a pair of retention slots 44 that may be located on central portion 36 and arranged on opposite sides of rear shell 22. In some embodiments, slots 44 may be bores that form a passageway extending from an interior surface 46 to an exterior surface 40 of rear shell 22. In such a configuration, slots 44 penetrate through rear shell 22 and into cavity 30 (FIG. 5). Retention slots 44 are sized to engage a snap-lock catch 56 of cantilever structure 52 as described in more detail below with reference to front shell 24. In other embodiments, retention slots 44 may not penetrate through rear shell 22, but may instead be entirely contained and formed on interior surface 46 at a sufficient depth to engage snap-lock catch 56.

With reference FIGS. 4 and 5, the following description relates to features of front shell 24. Front shell 24 includes a cantilever structure 52 extending outwardly from a rear face 48 along or parallel to the axis 12. Cantilever structure 52 may include one or more cantilever beams 54, each having a snap-lock catch 56 on a free end thereof. Snap-lock catch 56 includes a radiused or curved surface 58 and a neck 60 that engages an edge 88 of retention slot 44 as further described in detail below. In some embodiments, cantilever beams 54 may further include a number of grooves 50 formed on an interior surface 51 (i.e., a surface facing axis 12). Grooves 50 may facilitate gripping a cable or wiring (not shown) and function as a strain relief or overall shield braids of a wiring pair.

As illustrated in FIG. 4, in one configuration having two cantilever beams 54, each beam 54 extends generally parallel to axis 12, with interior surface 51 facing one another and catch 56 facing in opposite directions. In this parallel configuration, catch 56 is arranged to correspond with the position of slots 44 of rear shell 22. In other embodiments, cantilever structure 52 may include more than two beams 54 that may be arranged in any variety of configurations as desired.

Preferably, cantilever structure 52, including beams 54 and catch 56, is integrally formed as a part of the front shell 24. For instance, front shell 24 and cantilever structure 52 may be formed as a monolithic structure, such as by a molding, casting, or injection molding process. Alternatively, front shell 24 and cantilever structure 52 may be machined from a single block of metal. In still other embodiments, front shell 24 and cantilever structure 52 may be formed as separate components and cantilever structure 52 may be fastened, adhered, welded, or otherwise mounted using any suitable techniques.

As mentioned previously, rear and front shells 22, 24 house an insulating sheath 64 therein. Insulating sheath 64 is preferably a non-conductive enclosure that may be molded or machined from a polymeric material, such as, fiber reinforced or unreinforced thermoplastic polyetherimide resin. Insulating sheath 64 holds pin contacts 66 extending outwardly from a front end 68 in alignment with the axial direction 12. In some embodiments, insulating sheath 64 may include an integrated cantilever top 70 with a button 72 positioned on a top surface 74 of cantilever top 70. When sheath 64 is inserted between rear and front shells 22, 24, button 72 may contact an inner wall 76 of front shell 24 to press cantilever top 70 downward toward pin contacts 66 to help pinch and retain pin contacts 66 in position. Additional details and other example embodiments of insulating sheaths are described in detail in U.S. patent application Ser. No. 13/314,174, filed Dec. 7, 2011 and published as U.S. Publication No. 2012/0171884, the disclosure of which is incorporated by reference by reference herein.

The following section provides additional details of interior components of rear and front shells 22, 24 and describes an example assembly method for mating rear and front shells 22, 24 to form plug connector 15. It should be understood that the plug connector 15 may be assembled in a variety of ways and that the steps described below are not intended to establish a particular sequence of assembly.

With particular reference to FIG. 5, insulating sheath 64 is inserted into front shell 24 and pushed forward until front end 68 of sheath 64 contacts a collar 78 formed on inner wall 76 of front shell 24. Preferably, no tools are needed to insert sheath 64 into front shell 24. Sheath 64 slides into front shell 24 until front end 68 of sheath 64 is flush (or substantially flush) against a face 80 of collar 78. In some embodiments, inner wall 76 and sheath 64 may have corresponding dimensions to provide an interference fit for securely retaining the sheath 64 therein. In other embodiments, the sheath 64 and the inner wall 76 may each include corresponding keying features (not shown) to securely lock the sheath 64 in position. Front shell 24 includes an opening or bore 82 formed through or between collar 78 to accommodate pin contacts 66 when sheath 64 is inserted.

After sheath 64 is secured within front shell 24, rear shell 22 may be moved along the axial direction 12 toward front shell 24 so that cantilever beams 54 enter cavity 30. In some instances, cantilever beams 54 may need to be pinched slightly toward each other (e.g., toward the axis 12) to ensure that cantilever beams 54 properly enter cavity 30. As rear shell 22 is moved along the axial direction 12 toward front shell 24, curved surface 58 of catch 56 rides against interior surface 46 of rear shell 22. When catch 56 reaches slots 44, catch 56 snaps into slots 44 and latches together rear and front shells 22, 24. In this configuration, neck 60 engages an edge 88 of rear shell 22 to retain cantilevered beams 54 in position and resist pulling apart the rear and front shells 22, 24. In some embodiments, interior surface 46 may taper or narrow inwardly from front face 28 toward retention slots 44 so as to urge cantilever beams 54 inwardly toward one another. In such embodiments, when catch 56 engages slots 44, catch 56 may be driven outwardly to form a solid mechanical engagement with slots 44.

To retain sheath 64 in position, rear shell 22 further includes an internal stop 90 formed as part of interior surface 46 within cavity 30. In an assembled configuration, a rear end 92 of sheath 64 rests against stop 90 to securely retain sheath 64 within plug connector 15. Preferably, slots 44 and stop 90 are each positioned a distance inward from front face 28 of rear shell 22, and sheath 64 and cantilever beams 54 are dimensioned so that rear end 92 of sheath 64 contacts stop 90 simultaneous with catch 56 engaging retention slot 44. In such configuration, sheath 64 is tightly secured within plug connector 15 to limit or eliminate any sliding movement of sheath 64 within plug connector 15.

After rear and front shells 22, 24 have been latched together, a heat-shrink tubing or other material may be applied to seal plug connector 15 as described previously. In some embodiments, front shell 24 may include one or more grooves 62 with similar structure and function as grooves 38 on rear shell 22. In such embodiments, the heat-shrink tubing may cover all of rear shell 22 and up to or beyond grooves 62 of front shell 24 to help maintain the moisture seal at the junction of the rear and front shells 22, 24.

As mentioned previously, socket connector 20 may include several components that are identical to or similar as components forming plug connector 15. It should be understood that it may not be necessary for plug and socket connectors 15, to use identical components, and that such components may include some differences. One advantage of using identical components is to reduce the number of unique components necessary to create an electrical connector, such as electrical connector system 10.

Figure 7:
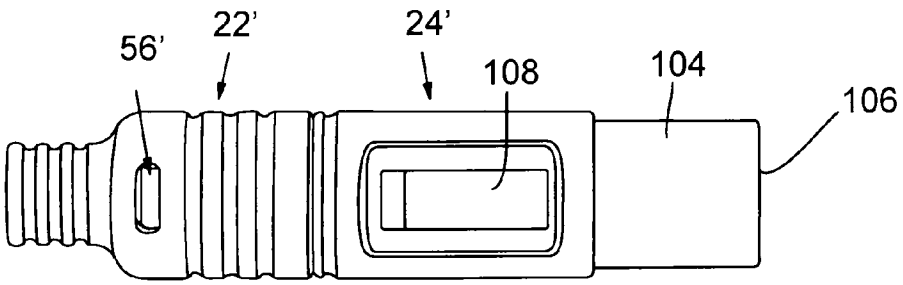
FIG. 7 is a side view of the socket connector of FIG. 1.
Figure 8:
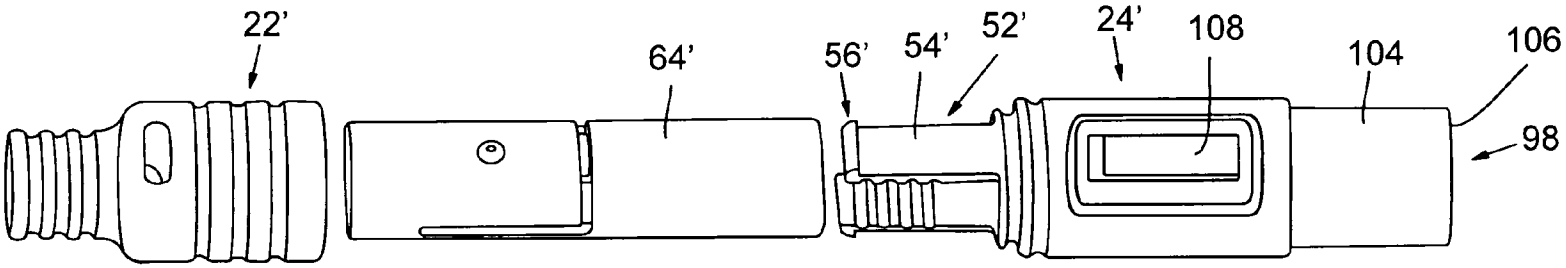
FIG. 8 is an exploded view of the socket connector of FIG. 7.

To provide a brief summary of its components, socket connector 20 is described generally with reference to FIGS. 7-8. Socket connector 20 includes rear and front shells 22', 24' and an insulating sheath 64' housed therebetween. Insulating sheath 64' houses multiple socket contacts 94 that mate with pin contacts 66 of plug connector 15. Sheath 64' may be inserted into front shell 24' in similar steps as described with respect to sheath 64 of plug connector 15. In some embodiments, sheath 64' may be longer than sheath 64 to house the entire length of socket contacts 94 to avoid exposing any portion of socket contacts 94. Socket connector 20 further includes cantilever structure 52' on front shell 24' that mates with retention slots 44' of rear shell 22' to latch together rear and front shells 22', 24' and securely retain sheath 64' therein.

One difference between plug and socket connectors 15, 20 is their respective mating ends 96, 98. Mating ends 96, 98 include features configured to mate with one another to form electrical connector system 10. Such keying features are further described below with respect to an example embodiment illustrated in the figures. It should be understood that these mating features may be interchangeable between plug and socket connectors 15, 20 without departing from the principles of the disclosure.

With reference to FIGS. 4-6, mating end 96 of plug connector 15 includes cantilevered tangs 100, which may be formed as an integral part of front shell 24. In some embodiments, tangs 100 may be formed by creating longitudinal slits 102 on front shell 24. Preferably, slits 102 are formed on mating end 96 to create a pair of opposing tangs 100. In other embodiments, mating end 96 may include more tangs 100 that may be created by making additional slits 102.

With reference to FIGS. 7-9, front shell 24' of socket connector 20 includes a tongue 104 on mating end 98. Tongue 104 may be dimensioned to have a slightly smaller circumference relative to mating end 96 of front shell 24 to provide an interference fit between tangs 100 and tongue 104 when plug and socket connectors 15, 20 are mated. Further details of a mated configuration are described below.

FIG. 6 illustrates a view of mating end 96 of plug connector 15 according to one embodiment and FIG. 9 illustrates a view of mating end 98 of socket connector 20 according to another embodiment. With particular reference to FIGS. 6 and 9, the following describes an example assembly of mating plug and socket connectors 15, 20 to form electrical connector system 10.

As illustrated in FIGS. 6 and 9, respectively, mating end 96 includes exposed pin contacts 66 aligned along axis 12 and mating end 98 includes socket contacts 94 aligned along axis 12. Preferably, pin contacts 66 do not extend beyond mating end 96 to protect pin contacts 66 from damage. In some embodiments, collar 78 of front shell 24 (FIG. 5) may include an internal pocket 84 for receiving a facial seal 86 that functions to form an environmental seal and hinder moisture, dust, or other contaminants from entering plug connector 15. Facial seal 86 is made from a resilient material and sits in pocket 84 without being glued or otherwise adhered in place. In some embodiments, facial seal 86 may be a standard O-ring. Additional details relating to facial seal 86 are discussed below with relation to mating plug connector 15 and socket connector 20.

In one assembly of electrical connector system 10, plug connector 15 is moved in the axial direction 12 toward socket connector 20. As plug and socket connectors 15, 20 are slidably moved together and mated, pin contacts 66 are inserted into socket contacts 94. Plug and socket connectors 15, 20 may be pushed toward one another until a front end 106 of tongue 104 contacts facial seal 86 of plug connector 15. Front end 106 may compress facial seal 86 into pocket 84 as the plug and socket connectors 15, 20 are mated. When fully mated, front end 106 of tongue 104 contacts and rests against front face 79 of collar 78.

Preferably, plug and socket connectors 15, 20 are not twisted or rotated when they are jointed, but are instead linearly joined along axial direction 12 so that pure compression forces are imparted to facial seal 86. Such linear compression without substantial torsion provides controlled, predictable compression and expansion of facial seal 86 as well as helps prevent tearing or otherwise breaking down the material of facial seal 86.

In a mated configuration, tangs 100 of plug connector 15 surround tongue 104 of socket connector 20. In this configuration, tangs 100 bear against tongue 104 and provide a solid mechanical connection between plug and socket connectors 15, 20. Tangs 100 help preserve a solid mechanical connection between plug and socket connectors 15, 20 to maintain shielding at the mating junction against external electromagnetic interference that may otherwise interfere with the cables terminated by plug and socket connector 15, 20.

Figure 10:
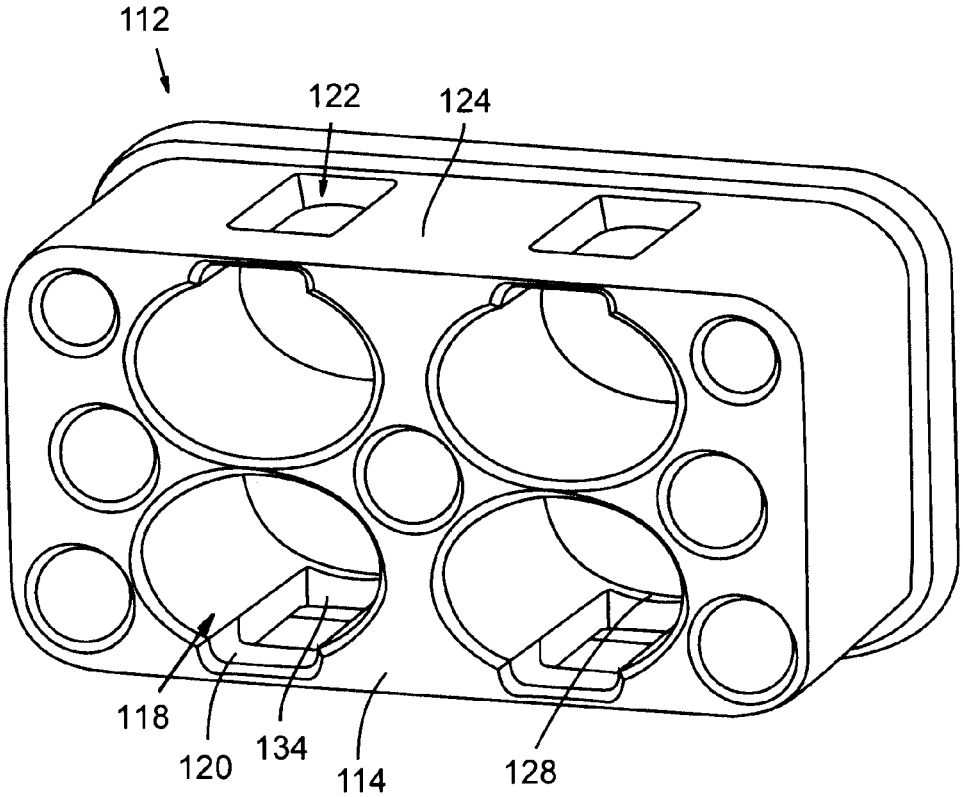
FIG. 10 is a perspective view of an insert for receiving the electrical connector assembly of FIG. 1.
Figure 11:
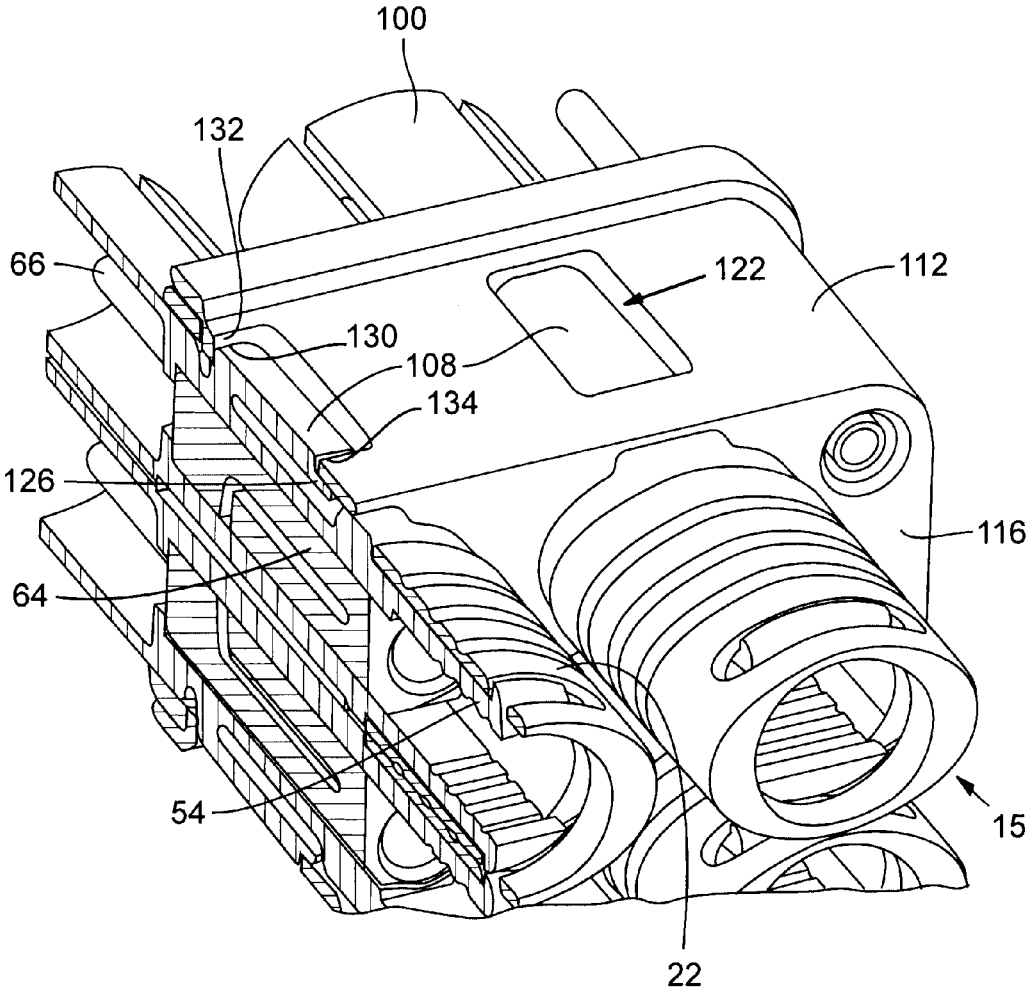
FIG. 11 is a cross-section view of the electrical connector assembly mated with the insert of FIG. 10.

In some embodiments, electrical connector system 10 may be part of a larger assembly of similar connectors. For instance, electrical connector system 10 may be inserted into a larger connector housing (not shown), such as a housing for a MIL-DTL-38999 connector. FIGS. 10 and 11 illustrate an example embodiment of a housing insert 112 that may be used to house plug and socket connectors 15, 20 within a larger connector housing.

With reference to FIGS. 10 and 11, housing insert 112 includes a front face 114, an opposite back face 116, and a bore 118 extending between the faces 114, 116. Bore 118 includes a recessed channel 120 that may extend from front face 114 to a shoulder 134 formed a distance inward of back face 116. Bore 118 is dimensioned to slidably receive plug and socket connectors 15, 20 and may have a general oval shape corresponding to an oval shape of plug and socket connectors 15, 20. It should be understood that in other embodiments, bore 118 may be another shape, such as a circular shape, to correspond to the shape of the plug and socket connectors 15, 20. Housing insert 112 further includes a slot 122 formed on a top surface 124. In some embodiments, slot 122 penetrates through housing insert 112 from top surface 124 into recessed channel 120. The bore 118, channel 120, and slot 122 are sized to receive and engage a retention latch 108 of plug and socket connectors 15, 20 (see FIG. 1). Additional details of retention latch 108 and an example mating arrangement are described below.

Figure 3:
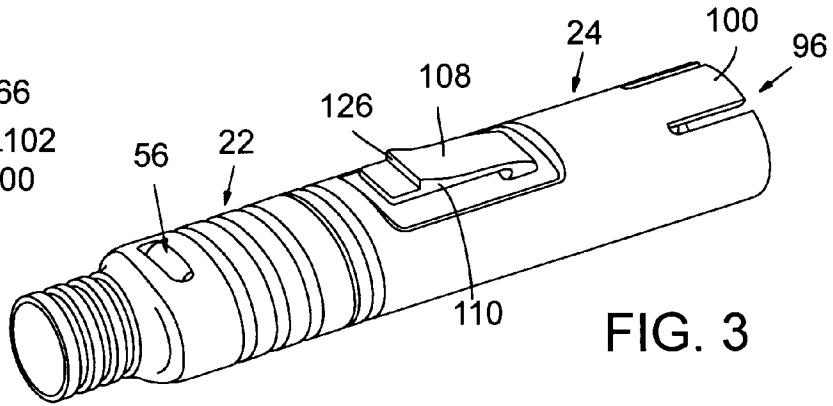

With particular reference to FIGS. 1 and 3, plug and socket connectors 15, 20 each include a retention latch 108. Retention latch 108 is preferably formed as an integral part of front shell 24 and includes a cantilevered arm 110 and a catch 126. In some embodiments, retention latch 108 may be recessed inwardly into rear shells 24, 24' to help minimize exposure of retention latch 108 and protect against potential damage to cantilevered arm 110.

FIG. 11 illustrates a mated configuration of plug connector 15 with housing insert 112. Although not illustrated or specifically described, the same or similar assembly process may be used to insert socket connector 20 into housing insert 112. With reference to FIG. 11, plug connector 15 slides into bore 118 through back face 116 of housing insert 112. As plug connector 15 slides through bore 118, cantilevered arm 110 of retention latch 108 is pushed downward toward front shell 24 by an interior edge 128 of shoulder 134. Plug connector 15 slides through bore 118 until retention latch 108 snaps into channel 120 and through slot 122. In this locked configuration, plug connector 15 sits securely within housing insert 112, with a leading edge 130 of retention latch 108 being flush against a front surface 132 of channel 120 and catch 126 being flush against a shoulder 134 of channel 120. Housing insert 112 may then be seated in a larger connector housing, such as a MIL-DTL-38999 connector or other connectors.

In some embodiments, housing insert 112 may include any number of bores 118 (e.g., four bores 118 are shown in FIG. 11) to retain a desired number of connectors 15, 20. In addition, in other embodiments, channel 120 and slot 122 may be at different positions relative to the positions shown in FIG. 11 to allow for various configurations of connectors 15, 20. For instance, channel 120 and slot 122 may be at ±90 degrees relative to the position illustrated in FIG. 11 and the plug connector 15 would be similarly rotated. Accordingly, it should be understood that a number of configurations may be achieved by altering the position of channel 120 and slot 122 as desired.

It will be obvious to those having skill in the art that many changes may be made to the details of the above-described embodiments without departing from the underlying principles of the invention. The scope of the present invention should, therefore, be determined only by the following claims.

The invention claimed is:

1. An electrical connector, comprising:

a rear shell having a first cavity extending in an axial direction, the rear shell further including a retention slot;

a front shell having a rear face and an opposite mating end, the front shell including a second cavity extending in the axial direction;

a cantilever structure extending from the rear face of the front shell in the axial direction, the cantilever structure having a catch on a free end thereof, wherein, when the front and rear shells are mated, the cantilever structure extends into the first cavity of the rear shell and the catch of the cantilever structure engages the retention slot to latch together the front and rear shells such that the first and second cavities are abutting and together define an elongate contact-receiving cavity;

an insulating sheath housing electrical contacts, the insulating sheath carried in the contact-receiving cavity; and a stop formed on an interior surface of the rear shell within the first cavity, the stop retaining the insulating sheath within the contact-receiving cavity when the front and rear shells are mated.

2. The electrical connector of claim 1, wherein the mating end of the front shell includes a plurality of slits that form at least two tangs.

3. The electrical connector of claim 1, further comprising:

a recessed surface formed on an exterior of at least one of the front or rear shells; and a retention latch carried on the recessed surface by the at least one of the front or rear shells, the retention latch having a resilient arm for engaging a corresponding mating feature on a connector housing to secure the electrical connector within the connector housing.

4. The electrical connector of claim 1, the rear shell further comprising an interior surface extending between a front face and an opposite rear face of the rear shell, wherein a portion of the interior surface tapers inwardly from the front face toward the retention slot such that the catch bears against the tapered interior surface as the front and rear shells are being mated.

5. The electrical connector of claim 1, the front shell further comprising a collar formed on an interior surface of the front shell within the second cavity, the collar retaining the insulating sheath within the contact-receiving cavity when the front and rear shells are mated.

6. The electrical connector of claim 1, the rear shell further comprising multiple spaced-apart circumferential grooves around an exterior surface of the rear shell.

7. The electrical connector of claim 6, the front shell further comprising at least one circumferential groove around an exterior surface of the front shell proximal a rear face of the front shell.

8. The electrical connector of claim 1, wherein both the front shell and the rear shell are electrically conductive.

9. An electrical connector assembly comprising:

a first connector comprising:

an electrically conductive rear shell having a retention slot;

an electrically conductive front shell having a rear face, an opposite mating end, and a contact-receiving cavity formed therebetween, the front shell including a cantilever structure extending from the rear face in an axial direction, the cantilever structure having a catch on a free end thereof, the catch engaging the retention slot to latch together the front and rear shells, the front shell further including a plurality of slits that form tangs on the mating end; and an insulating sheath housing electrical contacts therein, the insulating sheath carried within the contact-receiving cavity;

a second connector comprising:

an electrically conductive rear shell having a retention slot;

an electrically conductive front shell having a rear face, an opposite mating end, and a contact-receiving cavity formed therebetween, the front shell including a cantilever structure extending from the rear face in an axial direction, the cantilever structure having a catch on a free end thereof, the catch engaging the retention slot to latch together the front and rear shells, the front shell further including a tongue formed on the mating end; and an insulating sheath carrying electrical contacts therein, the insulating sheath seated within the contact-receiving cavity;

wherein, when the first and second connectors are mated, the tangs of the first connector surround the tongue of the second connector to retain the connectors in a mated configuration.

10. The electrical connector assembly of claim 9, wherein the cantilever structure of each of the first and second connectors is formed as an integral part of the front shells of the first and second connectors.

11. The electrical connector assembly of claim 9, further comprising:

a recessed surface formed on an exterior surface of at least one of the first or second connectors; and a retention latch carried on the recessed surface, the retention latch having a resilient arm for engaging a corresponding mating feature on a connector housing to secure the electrical connector assembly within the connector housing.

12. The electrical connector assembly of claim 9, wherein the rear shell of each of the first and second connectors further comprises multiple spaced-apart circumferential grooves around an exterior surface of the rear shell.

13. The electrical connector assembly of claim 12, wherein the front shell of each of the first and second connectors further comprises at least one circumferential groove around an exterior surface of the front shell proximal a rear face of the front shell.

14. The electrical connector assembly of claim 13, further comprising heat-shrink tubing gripping the circumferential grooves of the front and rear shells of the first and second connectors.

15. The electrical connector assembly of claim 9, further comprising a facial seal carried in a pocket formed within one of the first and second connectors, the facial seal compressing into the pocket when the first and second connectors are mated.

16. An electrical connector, comprising:

a rear shell having a first cavity extending in an axial direction and a retention slot, wherein the rear shell further includes an interior surface extending between a front face and an opposite rear face of the rear shell, a portion of the interior surface tapering inwardly from the front face toward the retention slot;

a front shell having a rear face and an opposite mating end, the front shell including a second cavity extending in the axial direction;

a cantilever structure extending from the rear face of the front shell in the axial direction, the cantilever structure having a catch on a free end thereof, wherein, when the front and rear shells are being mated, the cantilever structure extends into the first cavity of the rear shell and the catch of the cantilever structure bears against the tapered interior surface of the rear shell and engages the retention slot to latch together the front and rear shells such that the first and second cavities are abutting and together define an elongate contact-receiving cavity; and an insulating sheath housing electrical contacts, the insulating sheath carried in the contact-receiving cavity.

17. The electrical connector of claim 16, further comprising a stop formed on an interior surface of the rear shell within the first cavity, the stop retaining the insulating sheath within the contact-receiving cavity when the front and rear shells are mated.

18. The electrical connector of claim 16, the front shell further comprising a collar formed on an interior surface of the front shell within the second cavity, the collar retaining the insulating sheath within the contact-receiving cavity when the front and rear shells are mated.

19. The electrical connector of claim 16, further comprising:

a recessed surface formed on an exterior of at least one of the front or rear shells; and a retention latch carried on the recessed surface by the at least one of the front or rear shells, the retention latch having a resilient arm for engaging a corresponding mating feature on a connector housing to secure the electrical connector within the connector housing.

20. An electrical connector, comprising:

a rear shell having a first cavity extending in an axial direction, the rear shell further including a retention slot;

a front shell having a rear face and an opposite mating end, the front shell including a second cavity extending in the axial direction;

a cantilever structure extending from the rear face of the front shell in the axial direction, the cantilever structure having a catch on a free end thereof, wherein, when the front and rear shells are mated, the cantilever structure extends into the first cavity of the rear shell and the catch of the cantilever structure engages the retention slot to latch together the front and rear shells such that the first and second cavities are abutting and together define an elongate contact-receiving cavity;

an insulating sheath housing electrical contacts, the insulating sheath carried in the contact-receiving cavity;

a recessed surface formed on an exterior of at least one of the front or rear shells; and a retention latch carried on the recessed surface by the at least one of the front or rear shells, the retention latch having a resilient arm for engaging a corresponding mating feature on a connector housing to secure the electrical connector within the connector housing.

21. The electrical connector of claim 20, further comprising a stop formed on an interior surface of the rear shell within the first cavity, the stop retaining the insulating sheath within the contact-receiving cavity when the front and rear shells are mated.

22. The electrical connector of claim 20, the front shell further comprising a collar formed on an interior surface of the front shell within the second cavity, the collar retaining the insulating sheath within the contact-receiving cavity when the front and rear shells are mated.

23. The electrical connector of claim 20, the rear shell further comprising an interior surface extending between a front face and an opposite rear face of the rear shell, wherein a portion of the interior surface tapers inwardly from the front face toward the retention slot such that the catch bears against the tapered interior surface as the front and rear shells are being mated.

24. The electrical connector of claim 20, wherein both the front shell and the rear shell are electrically conductive.

25. An electrical connector, comprising:

a rear shell having a first cavity extending in an axial direction, the rear shell further including a retention slot and multiple spaced-apart circumferential grooves around an exterior surface of the rear shell;

a front shell having a rear face and an opposite mating end, the front shell including a second cavity extending in the axial direction;

a cantilever structure extending from the rear face of the front shell in the axial direction, the cantilever structure having a catch on a free end thereof, wherein, when the front and rear shells are mated, the cantilever structure extends into the first cavity of the rear shell and the catch of the cantilever structure engages the retention slot to latch together the front and rear shells such that the first and second cavities are abutting and together define an elongate contact-receiving cavity; and an insulating sheath housing electrical contacts, the insulating sheath carried in the contact-receiving cavity.

26. The electrical connector of claim 25, the front shell further comprising at least one circumferential groove around an exterior surface of the front shell proximal a rear face of the front shell.

27. The electrical connector of claim 25, further comprising:

a stop formed on an interior surface of the rear shell within the first cavity; and a collar formed on an interior surface of the front shell within the second cavity, wherein the stop and the collar retain the insulating sheath within the contact-receiving cavity when the front and rear shells are mated.

* * * * *

UNITED STATES PATENT AND TRADEMARK OFFICE

CERTIFICATE OF CORRECTION

PATENT NO. : 8,979,592 B2
APPLICATION NO. : 13/841092
DATED : March 17, 2015
INVENTOR(S) : Phong Dang It is certified that error appears in the above-identified patent and that said Letters Patent is hereby corrected as shown below:

In the Specification

In column 3, line 24, please replace "connectors 15," with --connectors 15, 20--.

In column 6, line 26, please replace "connectors 15," with --connectors 15, 20--.

Signed and Sealed this
Twenty-third Day of June, 2015

Michelle K. Lee

Michelle K. Lee
*Director of the United States Patent and Trademark Office*